US006629866B2

(12) United States Patent
Burg

(10) Patent No.: US 6,629,866 B2
(45) Date of Patent: Oct. 7, 2003

(54) MARINE VEHICLE PROPULSION SYSTEM

(76) Inventor: Donald E. Burg, 15840 SW. 84th Ave., Miami, FL (US) 33157

( * ) Notice: Subject to any disclaimer, the term of this patent is extended or adjusted under 35 U.S.C. 154(b) by 94 days.

(21) Appl. No.: 09/809,414

(22) Filed: Mar. 15, 2001

(65) Prior Publication Data

US 2002/0052156 A1 May 2, 2002

Related U.S. Application Data

(63) Continuation-in-part of application No. 09/702,905, filed on Oct. 26, 2000, now abandoned.

(51) Int. Cl.[7] ..... B63H 11/00
(52) U.S. Cl. ..... 440/38; 440/41; 440/43
(58) Field of Search ..... 440/38, 40–43, 440/47; 60/221

(56) References Cited

U.S. PATENT DOCUMENTS 3,343,368 A * 9/1967 Castoldi
4,929,200 A * 5/1990 Guezou et al.
5,505,639 A * 4/1996 Burg ..... 440/42
5,720,636 A * 2/1998 Burg ..... 440/41

* cited by examiner

*Primary Examiner*—Ed Swinehart
(74) *Attorney, Agent, or Firm*—Robert J. Van Der Wall

(57) ABSTRACT

Presented is an improved marine vehicle propulsion system that utilizes a water accelerating rotor that operates efficiently when either partially or fully submerged all the while enclosed in a duct like a standard pump impeller pressurized nozzle waterjet. This new waterjet propulsor has a simple gas supply system without moving parts that supplies either gas or water to the water accelerating rotor dependent upon level of the waterline relative to the gas supply's inlet. One or more fluid inlet flow directing valve elements are offered that can vary the level of water reaching the rotor's inlet and can also, in an extended position, prevent water from impacting the waterjet's inlet. The latter item is valuable when the marine vehicle is either being towed or when it is being propelled by another propulsor as it reduces drag due to water flowing through an inoperative instant invention waterjet propulsor. Further, both ram or flush inlets may be used with the ram inlet being, at least in its majority, positioned above the marine vehicle forward of it. A multi-element flow reversing bucket system is also offered.

56 Claims, 5 Drawing Sheets

MARINE VEHICLE PROPULSION SYSTEM

CROSS REFERENCE TO OTHER APPLICATIONS

This application is a continuation-in-part to Applicant's earlier filed application Ser. No. 09/702,905 file Oct. 26, 2000, now abandoned.

BACKGROUND OF THE INVENTION

The instant invention falls in the field of marine propulsion systems that utilize enclosed powered rotors that accelerate water or fluids taken from external to a marine vehicle to thereby generate a propelling thrust. They are commonly known as waterjet propulsors. In commercially available state-of-the-art waterjet propulsors a powered rotor or impeller builds up a pressure in water forward of a discharge nozzle that discharges to atmosphere. The differential pressure across the discharge nozzle results in a jet velocity that, when discounted for incoming water picked up at marine vehicle velocity and multiplied by the mass flow of water, gives the resulting thrust.

Several shortcomings of the present day waterjets are evident: 1) Since they have impellers that are basically simple water pressurizing pump impellers, they have a serious falloff in performance when air is ingested as is the case when operating in rough seas and/or when propelling air cushioned marine vehicles, 2) They are subject to impeller blade cavitation damage especially when running at high power levels at low marine vehicle speeds, 3) Their efficiencies at low marine vehicle speeds is generally considered to be poor with speeds of 35 knots or more considered necessary for optimum performance, 4) Their performance at very high marine vehicle speeds, say over 55 knots or so, is also poor due mainly to low efficiency of and high drag of their water inlets at the higher speeds, and 5) In multiple unit installations, drag of a non-operating waterjet is of a high magnitude due to water passing through the non-operating waterjet. In spite of all of their drawbacks, present day waterjets are seeing a lot of applications. These are primarily in craft that cruise mostly in the 35–50 knot area such as high speed ferries where their advantages of low maintenance and even engine loadings compared to open water propellers is valuable. They are also seeing application in small jetboats and personal watercraft where the loss of efficiency compared to the open water propeller is accepted for the added safety considerations of the enclosed rotor.

Presented here are some new concepts in a waterjet propulsor that solve all of the present-day waterjets just mentioned shortcomings. They are mainly improvements on a newer variation of a waterjet propulsor that uses a rotor that is supplied with gas over part of its rotation during it primary mode of operation. The basic ideas of this new type of propulsion system are given in Applicant's earlier U.S. Pat. Nos. 5,505,639, 5,730,636, and 6,024,614.

The instant invention waterjet propulsor not only supplies gas to its fluid-accelerating rotor during forward high speed propelling of a marine vehicle but also has a simple way to prevent gas from reaching the rotor when operating at low speed or during reversing. Preventing gas from reaching the rotor during low speed operation insures that the mass flow is about doubled which enhances thrust at low marine vehicle speeds. Also, it is particularly important to be able to prevent gas from reaching the rotor during reversing. This is because when the rotor is trying to build up pressure to impact a reversing bucket it tends to spin freely in a gas pocket if gas is entrained in the water. Little reversing thrust is generated in such a case. Lastly, an adjustable inlet fluid device can direct inlet water away from its water inlet to reduce drag of a non-operating unit.

SUMMARY OF THE INVENTION

With the foregoing in mind, it is a principal object of present invention to provide a new enclosed fluid accelerating rotor marine vehicle propulsion system that has an enclosed fluid accelerating rotor that is capable of operating efficiently when either partially or fully submerged in water.

It is a further related object of the invention that its inlet be a ram fluid inlet, as seen in vertical transverse planes of the improved waterjet propulsor with a rotational centerline of the fluid accelerating rotor horizontal, to thereby be, as a sum of its parts, a ram fluid inlet over a majority of 180 degrees of an arc.

It is yet another object of the invention that said ram fluid inlet be, at least in its majority, disposed above a lower portion of the marine vehicle forward of the ram fluid inlet.

Another object of the invention is that an adjustable inlet fluid directing means be disposed, at least in its majority, forward of said ram fluid inlet.

A further object of the invention is that it include a gas supply means that is capable of supplying gas to a forward portion of the fluid-accelerating rotor.

It is another object of the invention that the ram fluid inlet, on average, angles rearward from its upper to lower portions.

It is a further directly related object of the invention that the ram fluid inlet, on average, angle rearward from its upper to its lower portions at an angle of less than 60 degrees to a transverse horizontal plane of the improved waterjet propulsor when a rotational centerline of said fluid accelerating rotor is horizontal.

It is yet another directly related object of the invention that the ram fluid inlet, on average, angles rearward from its upper to its lower portions at an angle of less than 50 degrees to a transverse horizontal plane of the improved waterjet propulsor when a rotational centerline of said fluid accelerating rotor is horizontal.

A further directly related object of the invention is that the ram fluid inlet, on average, can angle rearward from its upper to its lower portions at an angle of less than 40 degrees to a transverse horizontal plane of the improved waterjet propulsor when a rotational centerline of said fluid accelerating rotor is horizontal.

Yet another object of the invention is that an inlet lip of said ram fluid inlet can be, at least in part, angled downward by an angle of less than twenty degrees to a transverse horizontal plane of the improved waterjet propulsor when a rotational centerline of said fluid accelerating rotor is horizontal.

A further refinement of the just mentioned object of the instant invention is that an inlet lip of said ram fluid inlet can be, at least in part, angled downward by an angle of less than fifteen degrees to a transverse horizontal plane of the improved waterjet propulsor when a rotational centerline of said fluid accelerating rotor is horizontal.

Yet another refinement to the just mentioned objects of the instant invention is that an inlet lip of said ram fluid inlet is, at least in part, angled downward by an angle of less than ten degrees to a transverse horizontal plane of the improved waterjet propulsor when a rotational centerline of said fluid accelerating rotor is horizontal.

It is still a further object of the invention that said ram fluid inlet is, at least in its majority, disposed below a rotational centerline of the fluid-accelerating rotor.

Another related object of the instant invention is that the ram fluid inlet is, at least in its majority, curvilinear in shape.

Yet another object of the invention is that an adjustable inlet fluid directing means can, when the marine is vehicle moving forward, direct a majority of incoming water away from impacting the ram fluid inlet.

A further object of the invention is that, when the marine vehicle is moving forward, an adjustable inlet fluid directing means can direct a majority of incoming water to the ram fluid inlet.

A related object of the instant invention is that the adjustable inlet fluid directing means can direct incoming water to at least a majority of an inlet of said fluid accelerating rotor.

It is a further object of the invention that the adjustable inlet fluid directing means can be composed of two or more fluid directing elements wherein said fluid directing elements are moveable in relation to the improved waterjet propulsor.

It is another object of the instant invention that movement of at least one of the fluid level directing elements is accomplished by forces supplied by an actuator.

It is a further object of the invention that one of said inlet fluid directing elements is a port inlet fluid directing element and another is a starboard inlet fluid directing element.

It is a directly related object of the present invention that it further include a center fluid-directing element that can be actuated by contact with the port or the starboard fluid-directing element.

It is yet a further object of the invention that a gas inlet of the gas supply means capable of supplying gas to the fluid accelerating rotor is, at least in its majority, above a waterline when the improved waterjet propulsor is generating forward thrust thereby supplying gas to a forward portion of the fluid accelerating rotor and submerged below a waterline when the improved waterjet propulsor is generating reverse thrust thereby supplying water to the fluid accelerating rotor.

It is a further object of the invention that the fluid-accelerating rotor rotates in the same direction when the improved waterjet propulsor is generating forward thrust as when it is generating reverse thrust.

It is yet another object of the invention that a gas inlet that supplies gas to the fluid accelerating rotor during forward operation of the marine vehicle is, at least in its majority, submerged below a waterline during reverse operation of the marine vehicle.

Yet another object of the invention is that it further comprise a steering rudder disposed, at least in its majority, aft of the fluid accelerating rotor and forward of a multi-element fluid reversing bucket.

A directly related object of the invention is that a housing portion forward of said steering rudder is, at least in its majority as seen in a vertical transverse plane of the improved waterjet propulsor, internally curvilinear in shape and a forward portion of said steering rudder, as seen in a profile view, is curvilinear in shape such that rotation of the steering rudder causes a biased sideways directing of fluid flow during reverse thrust operation of the improved waterjet propulsor.

It is an another object of the present invention that a housing portion forward of said steering rudder can be, at least partially as seen in a vertical transverse plane of the improved waterjet propulsor, internally rectangular in shape over an upper portion and curvilinear in shape over a lower portion and a forward portion of said steering rudder, as seen in a profile view, is rectangular in shape over an upper portion and curvilinear in shape over a lower portion such that rotation of the steering rudder causes a biased sideways directing of fluid flow during reverse thrust operation of the improved waterjet propulsor.

It is a further related object of the instant invention that the multi-element fluid-reversing bucket comprises an element that is in mechanical communication with reverse fluid flow directing nozzles.

A related object of the invention is that power for movement of a first element of said multi-element fluid reversing bucket is provided by an actuator and wherein movement of said first element of said multi-element fluid reversing bucket results in movement of an adjacent second element of said multi-element fluid reversing bucket.

A further and directly related object of the invention is that movement the second element of said multi-element fluid reversing bucket results in movement of an adjacent third element of said multi-element fluid reversing bucket.

A related object of the present invention is that an aft portion of the steering rudder is, at least during portions of its operation during reversing of the improved waterjet propulsor, in close proximity to an element of the fluid-reversing bucket.

Yet another object of the instant invention is that it may have a flush fluid inlet.

A directly related object of the invention is that the flush fluid inlet may be accompanied by an adjustable inlet fluid directing means disposed, at least in its majority, forward of said flush fluid inlet and wherein said adjustable fluid directing means is capable of directing incoming water away from said flush fluid inlet.

The invention will be better understood upon reference to the drawings and detailed description of the invention which follow in which:

DETAILED DESCRIPTION

Figure 1:
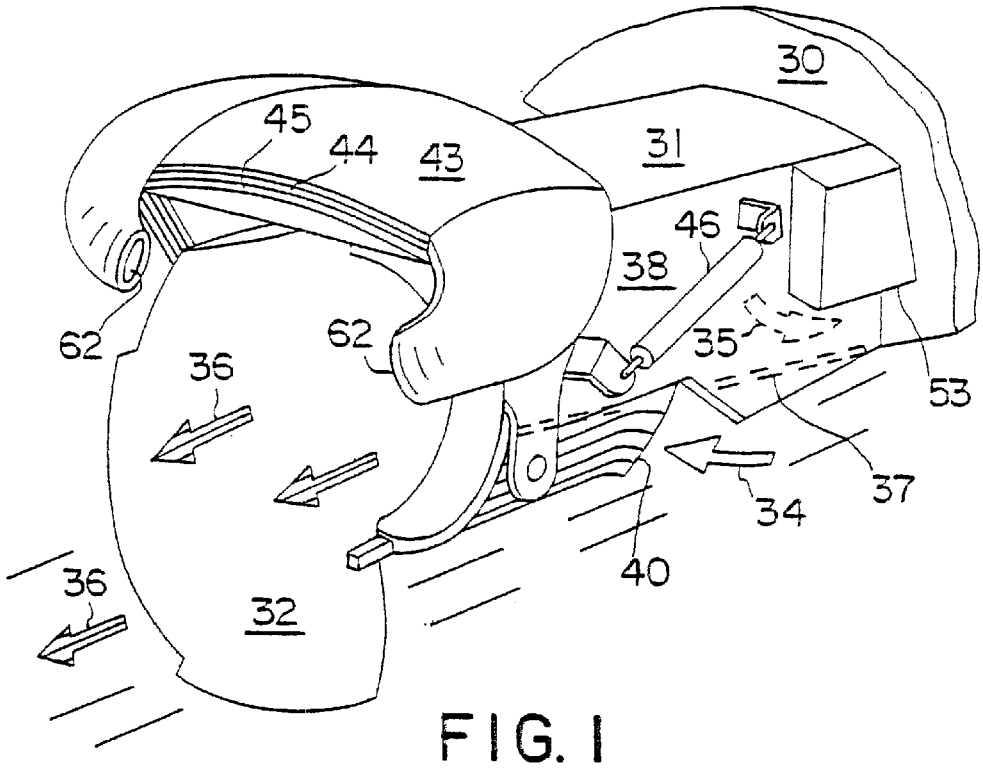
FIG. 1 presents a rear isometric view of the present invention improved waterjet propulsor as mounted to the transom of a marine vehicle. In this instance the reversing bucket members are up and out of the way since the marine vehicle is being propelled forward at high speed.

FIG. 1 presents a topside rear isometric view of the instant invention improved marine propulsor 31 as it is propelling a marine vehicle 30 forward at high speed. Items shown include: rudder 32, reversing bucket elements 43, 44, 45, water flow arrows 34, gas flow arrows 35, discharge jet mixed gas/water flow arrows 36, gas inlet 53, reversing bucket element actuator 46, housing 38, waterline 37, and fluid ram inlet 40.

Figure 2:
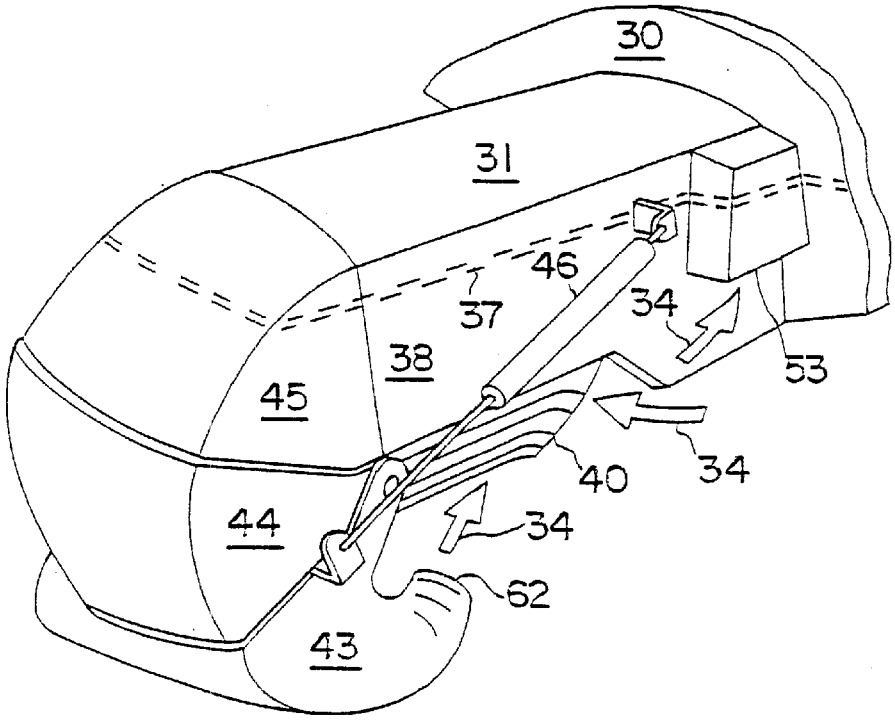
FIG. 2 is a similar rear isometric view of the instant invention but in this case with the reversing bucket members down so that the waterjet propulsor is generating reverse thrust. Note the different waterlines in FIGS. 1 and 2.

FIG. 2 gives a similar rear isometric view of the instant invention improved waterjet propulsor 31 as presented in FIG. 1 except in this instance it is operating in reverse with the reversing bucket elements in reverse position. The first multi-element reversing bucket element 43 is in mechanical communication with reversing nozzles 62, the second 44 and third 45 make up the reversing bucket here. It to be realized that any number from two to many reversing bucket elements may be used. Note that the waterline 37 here is high up on the housing 38 as is the case when reversing.

Figure 3:
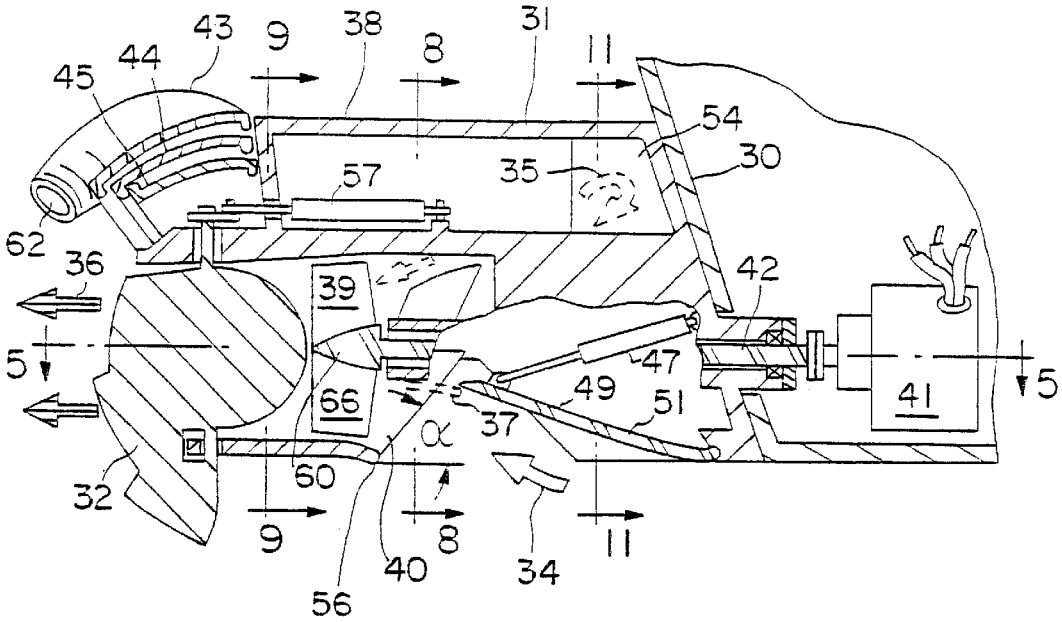
FIG. 3 is a cross-sectional view, as taken through a vertical centerline plane of the instant invention improved waterjet propulsor, that shows a ram water inlet to which fluid flow is controlled by a powered fluid directing means which in this case is a flap-like member. The steering and reversing system which is made up of a rudder and a multi-element flow reversing bucket. In this case, the multi-element flow-reversing bucket is up and out of the way as the improved waterjet propulsor is propelling the marine vehicle forward.

FIG. 3 presents a centerline cross-sectional view of the instant invention improved waterjet propulsor as taken through a vertical centerline plane of FIG. 1. Part of the shaft 42 and its housing have been omitted so that the center inlet flow directing valve 49 and port inlet flow directing valve 51 can be shown. The port inlet flow directing valve actuator 47 is also shown. Other items shown include a drive motor 41, drive shaft 42, drive shaft supports 63, fluid accelerating rotor 39, fluid accelerating rotor rotational centerline 60, rudder actuator 57, port gas inlet passageway 54, ram water inlet 40, inlet lip 56, and fluid accelerating rotor 39.

Some definition of a preferred angle for the inlet as it slopes aft from near the elevation of rotor rotational centerline to its lower level where it intersects the housing 38 in this preferred embodiment of the invention. The angle $\alpha$ is preferably angled aft by an angle of less than 60 degrees to a transverse horizontal plane of the improved waterjet propulsor when a rotational centerline 60 of the fluid accelerating rotor 39 is horizontal. The value of that angle can be called to be less than 50 degrees or less than 40 degrees with the less than 40 degrees felt to be best as that shallow angle tends to deflect debris better than the steeper angles. It is also evident that a curvilinear shape to the lower portion of the housing 38 aft of the ram inlet 40 will result in less fluid dynamic drag from passing water.

Figure 4:
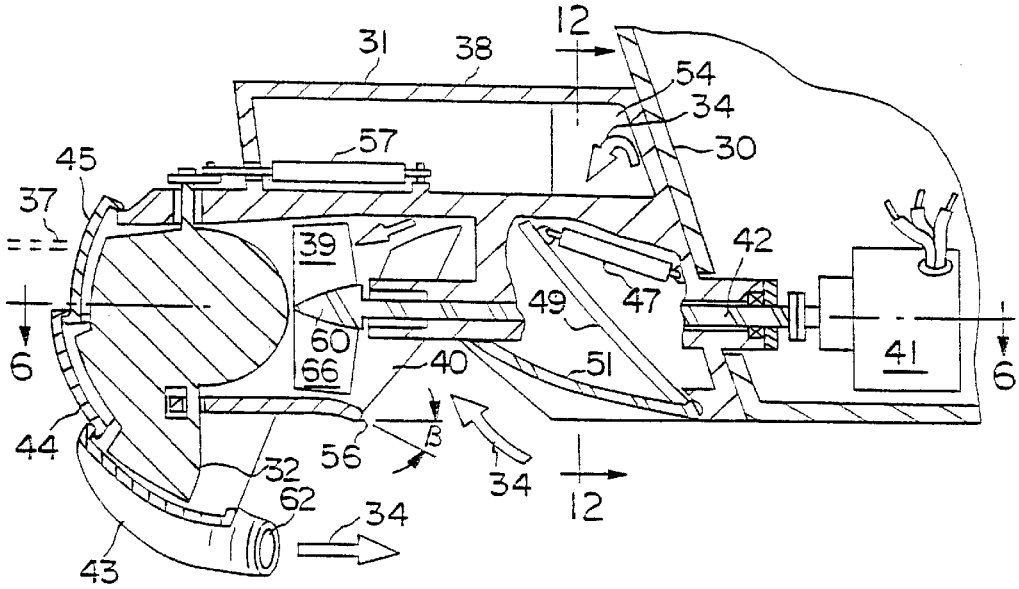
FIG. 4 is a similar centerline cross-sectional view as presented in FIG. 3 except in this instance the multi-element reversing bucket is down. This orientation of the reversing bucket redirects the fluid discharge from the fluid accelerating rotor forward to thereby create a forward thrust. Note the flow directing discharge nozzles on the lower reversing bucket element. Note also that the port side fluid inlet flow directing mechanism is up in this case to allow full water flow to the fluid-accelerating rotor.

FIG. 4 presents a centerline cross-sectional view of the instant invention improved waterjet propulsor as taken through a vertical centerline plane of FIG. 2. As for FIG. 3, part of the shaft 42 and its housing have been omitted so that the center inlet flow directing valve 49 and port inlet flow directing valve 51 can be shown. Note also that water is coming in through the gas passageway 54 as shown by the water flow arrow 34 coming out of that gas flow passageway 54. This is happening because of the height of the waterline 37 during reversing. Further, the port inlet fluid directing valve 49 is in a position to allow water to encompass the entire inlet of the fluid accelerating rotor 39. One more item to note is the first reversing bucket element 43 that is in mechanical communication with a reversing nozzle 62. Its position here gives a very favorable reverse flow direction to the fluids discharging from the reversing nozzle 62. When in the ahead thrust mode, a definition of marine vehicle 30 speed is given as follows: low speed is up to 15 knots and high speed is 15 knots or more.

This FIG. 4 also gives definition to the preferred downward angle of the ram inlet lip 56. That downward angle $\beta$ is defined as being less than twenty degrees to a transverse horizontal plane of the improved waterjet propulsor when the rotor rotational centerline 60 is horizontal. Lesser values for that angle $\beta$ are actually preferred with angles of less than fifteen degrees and less than ten degrees preferred.

Figure 5:
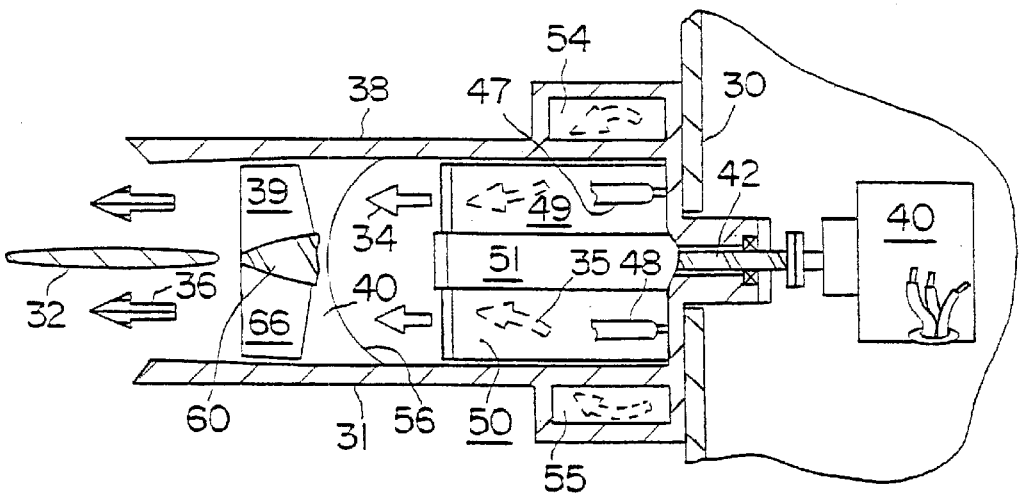
FIG. 5 is a cross-sectional view, as taken through line 5—5 of FIG. 3, that shows the rudder, fluid inlet directing valves, and gas inlet passageways. Note that a portion of the rotor drive shaft has been omitted for clarity here.

FIG. 5 presents a centerline cross-sectional view, as taken through line 5—5 of FIG. 3, that shows positioning of a port fluid inlet directing valve 49, center fluid inlet directing valve 51, and starboard fluid directing valve 50 in this ahead thrust condition. Note that the three valve elements 49, 50, and 51 are ideally linked together here to insure uniform flow to the fluid-accelerating rotor 39. Note also that the several valve elements may be combined as one single valve (not shown) if desired. The use of a one element inlet fluid directing valve is most appropriate when using alternative drive means that do not require a drive shaft 42 traversing the valve area. Some such alternative drive means are presented in Applicant's pending application U.S. Ser. No. 09/702,905.

Figure 6:
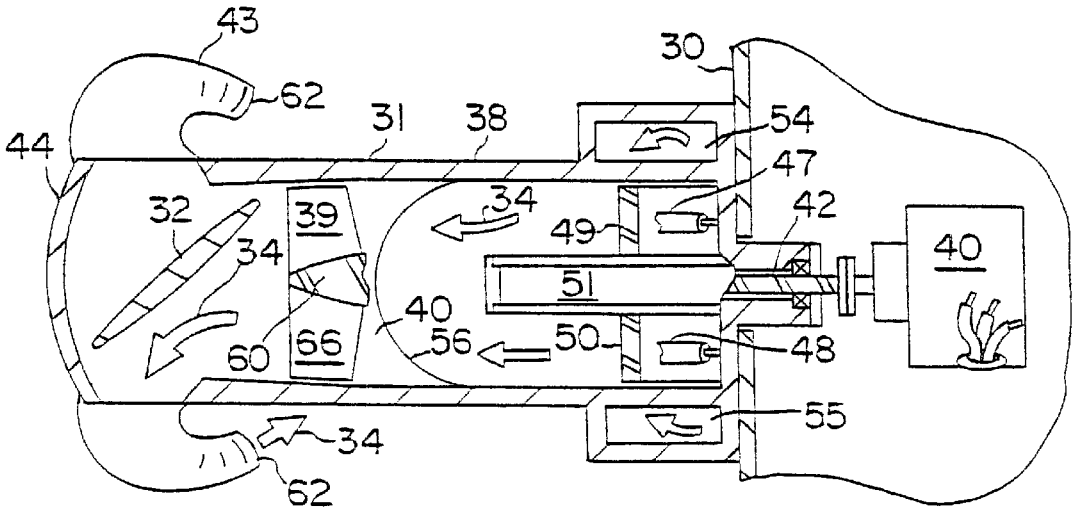
FIG. 6 is a cross-sectional view, as taken through line 6—6 of FIG. 4, that shows a similar situation to that presented in FIG. 5. However, in this FIG. 6, the unit is in reverse with the reversing bucket elements down and in position for reversing. For illustrative purposes, the rudder is shown cocked to one side to make for a reverse thrust to starboard.

FIG. 6 presents a centerline cross-sectional view, as taken through line 6—6 of FIG. 4, that shows positioning of inlet fluid directing valve elements 48, 49, 51 when the improved waterjet propulsor 31 is generating reverse thrust. The gas passageways 54, 55 in this case supply only water to the inlet of the fluid accelerating rotor 39. Note that by definition here, the rotor inlet is stated to be in a plane perpendicular to the fluid accelerating rotor rotational centerline plane 60 and proximal to and forward of at least a majority of the fluid accelerating rotor blades 66.

The position of the rudder 32 here in FIG. 6 is such that a reverse thrust to starboard is being generated as shown by the water direction arrow 34 leaving the nozzle 62 on the starboard side. The forward portion of the rudder 32 is near the port side of the housing 38 thereby allow only very little of the rotor discharge fluid to go to the nozzle 62 on the port side.

Figure 7:
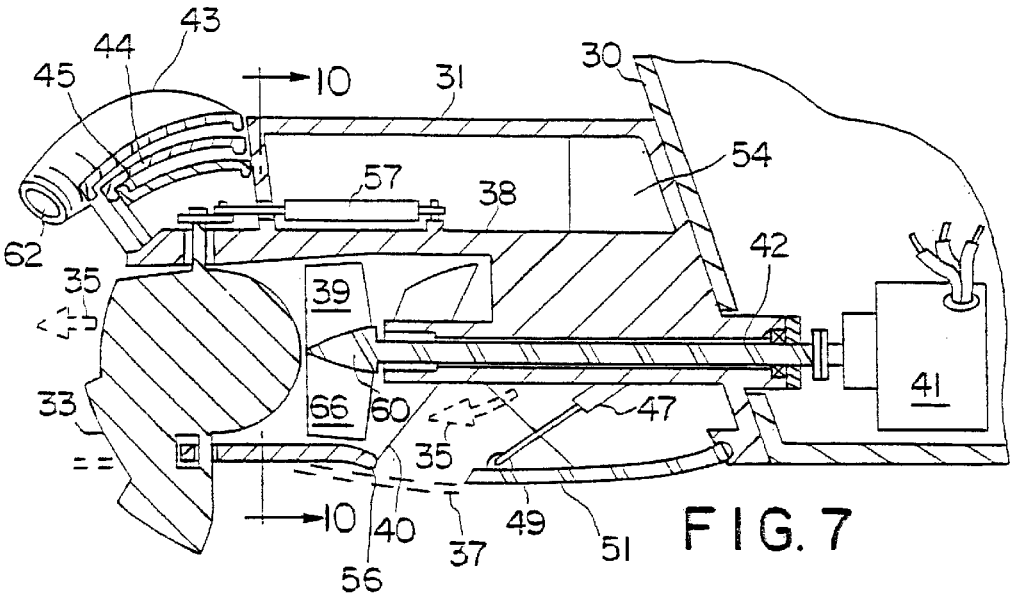
FIG. 7 presents a centerline cross-section as taken through a vertical centerline plane of the improved waterjet propulsor. It is similar to that presented in FIG. 3 except the fluid inlet flow directing valves are extended down to preclude water from entering the ram inlet. This condition is favored when the unit in question is inoperative and the marine vehicle is either being towed or is being propelled by other propulsors.

FIG. 7 is a similar centerline cross-sectional view as was presented in FIG. 3 except that the inlet fluid flow directing valve elements 49, 51 are extended downward to thereby direct oncoming water from impacting the ram inlet 40 or the ram inlet lip 56. This is a valuable condition in such event as towing of the marine vehicle 30 by another craft or operation with the waterjet propulsor 31 shown inoperative and propulsion power supplied by other propulsion systems in the marine vehicle 30. Note that the rudder 33 here has a curvilinear shape over its lower portion and a rectangular shape over its upper portion. This is accomplished, of course, by a similar shaping of the housing 38 adjacent to the rudder 33.

Figure 8:
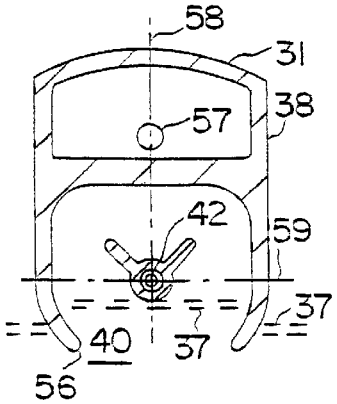
FIG. 8 is a cross-section, as taken through line 8—8 of FIG. 3 that shows part of the fluid ram inlet opening.

FIG. 8 presents a cross-section, as taken through line 8—8 of FIG. 3, that shows the ram inlet 40 and the ram inlet lip 56 at that cross-section. Also shown are a vertical centerline plane 58 and a horizontal centerline plane 59.

Figure 9:
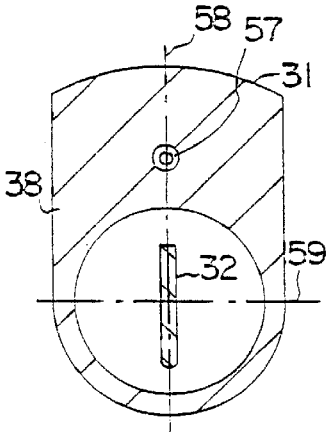
FIG. 9 is a cross-section, as taken through line 9—9 of FIG. 3 showing a forward portion of the rudder as disposed in side of a round rotor discharge duct.

FIG. 9 is a cross-section, as taken through line 9—9 of FIG. 3, that shows a forward end of a rudder 33 that in this case is inside of a circular housing.

Figure 10:
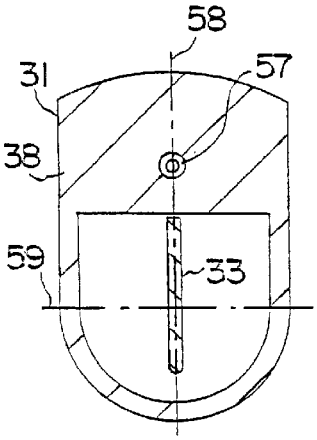
FIG. 10 presents a cross-section, as taken through line 10—10 of FIG. 7 that shows an alternative rudder design to that presented in FIG. 9. In this instance, the rudder is rectangular over its upper portion and is positioned inside of a duct with a rectangular upper portion.

FIG. 10 presents a cross-section, as taken through line 10—10 of FIG. 7, that shows an alternative rudder 33 and housing 38 design. In this instance, the housing 38 and the rudder 33 are rectangular in shape. This rectangular shape starts aft of the fluid-accelerating rotor.

Figure 11:
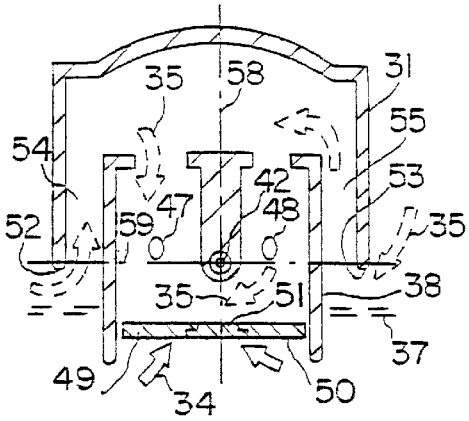
FIG. 11 presents a cross-section, as taken through line 11—11 of FIG. 3, that shows positioning of the inlet fluid directing valve(s) when the improved waterjet propulsor is propelling the marine vehicle forward. Gas flow to the fluid accelerating rotor is provided through passageways on the sides of the housing. Note that the openings to the gas passageways are above a waterline in this instance.

FIG. 11 presents a cross-section, as taken through line 11—11 of FIG. 3, that shows preferred positioning of inlet fluid directing valve elements 49, 50, 51 for the ahead thrust condition. Note that the three valve elements are united here. Actually, contact of either the port valve 49 or the starboard valve 50 will cause movement of the center valve element 51 as it is, in this preferred arrangement, a simple follower unit. Gas flow through gas flow passageways 54, 55 is indicated by gas flow arrows 35. The waterline 37 is shown below the gas passageway inlets 52, 53 which allows gas flow into those inlets.

Figure 12:
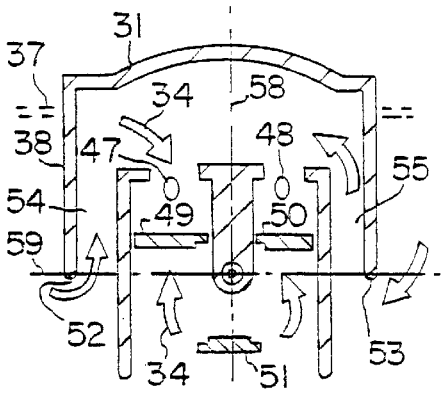
FIG. 12 is a cross-section, as taken through line 12—12 of FIG. 4, that shows the same items as FIG. 11 but in this case for the condition where reverse thrust is being generated by the improved marine propulsor.

FIG. 12 is a cross-section, as taken through line 12—12 of FIG. 4, that shows inlet fluid directing valve 49, 50, 51 positioning during reversing. Note that water is flowing up into the gas flow passageways 54, 55 in this reversing case since the waterline 37 is high up on the instant invention improved marine propulsor 31.

Figure 13:
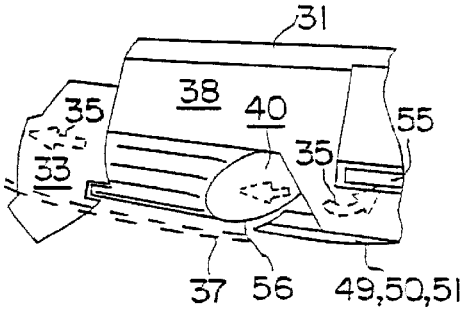
FIG. 13 is an isometric view, as seen from underwater, of the instant invention marine propulsor of FIG. 7. Note that in this case the inlet flow-directing valve is extended downward to thereby direct water away from the ram inlet. This would be the case when the marine vehicle is being towed or propelled by other propulsors. The multi-element reversing buckets are not shown in FIGS. 13 through 16 to simplify the figures.

FIG. 13 presents an isometric view from the underside of the improved marine propulsor 31 with the marine vehicle hull and the reversing elements not shown to simplify the figure. In this instance, the inlet fluid directing valve elements 49, 50, 51 are extended downward, as they were in FIG. 7, to thereby direct incoming water from impacting the fluid ram inlet 40 or the fluid ram inlet lip 56.

Figure 14:
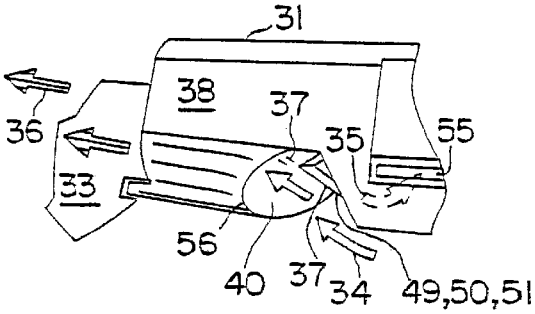
FIG. 14 presents another isometric view from underwater of the improved waterjet propulsor but in this case in the forward thrust condition as is shown in FIGS. 1 and 3.

FIG. 14 is a similar isometric view from underside as was presented in FIG. 13 except in this FIG. 14 the inlet fluid directing valve elements 49, 50, 51 are positioned as they were in FIG. 3. This positioning directs water flow to the ram inlet 40 and hence forward thrust can be generated by the instant invention waterjet propulsor 31.

Figure 15:
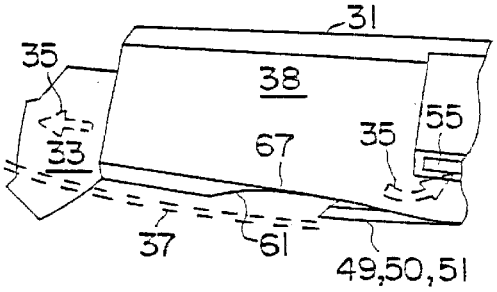
FIG. 15 gives a similar underwater isometric view as presented in FIG. 13 but in this case for a flush inlet rather than a ram inlet. Note that this flush inlet case requires a longer unit since the inlet fluid directing valve(s) must be further forward so that they do not run into the sides of the flush inlet.

FIG. 15 presents yet another concept in isometric view from underside. In this instance, the inlet is, at least in its majority, a flush inlet so the inlet fluid directing valve elements 49, 50, 51 must be placed further forward so that they will not encounter the flush inlet lip 67 when extended to their lower position. A flush inlet 61 is herein defined as having an inlet lip 67 that rises going from aft to forward, on average, by less than ten degrees from a horizontal plane parallel to the rotor rotational centerline when the rotor rotational centerline is horizontal.

Figure 16:
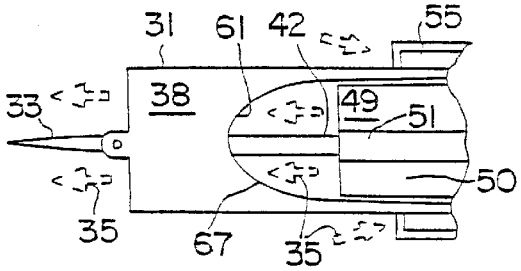
FIG. 16 is a bottom plan view of the flush inlet improved waterjet propulsor presented in FIG. 15.

FIG. 16 is a bottom plan view of the flush inlet case presented in FIG. 15. Note that the inlet fluid directing elements 49, 50, 51 are, at least in their majority, forward of the flush inlet lip 67 here. This is necessary to prevent interference when the fluid directing elements 49, 50, 51 are extended into their downward positions.

While the invention has been described in connection with a preferred and several alternative embodiments, it will be understood that there is no intention to thereby limit the invention. On the contrary, there is intended to be covered all alternatives, modifications, and equivalents as may be included within the spirit and scope of the invention as defined by the appended claims, which are the sole definition of the invention.

What I claim is:

1. In an improved waterjet propulsor in mechanical communication with and used for propelling a marine vehicle and having a water inlet and a fluid accelerating rotor where said fluid accelerating rotor is capable of operating efficiently when either partially or fully submerged in water, the improvement comprising:

said fluid accelerating rotor, over at least a majority of its lower half, surrounded by a rotor housing with said housing in mechanical communication with the water inlet with said water inlet disposed, at least in its majority, forward of a periphery of the fluid accelerating rotor, an adjustable inlet fluid directing means capable of directing a majority of incoming water away from impacting the water inlet when the marine vehicle is moving forward to thereby reduce resistance when the improved waterjet propulsor is not operating and the marine vehicle is moving forward, gas supply means capable of supplying gas to a forward portion of the fluid accelerating rotor.

2. The improved waterjet propulsor of claim 1 wherein said water inlet, on average, angles rearward from its upper to lower portions.

3. The improved waterjet propulsor of claim 2 wherein the water inlet, on average, angles rearward from its upper to its lower portions at an angle of less than 60 degrees to a transverse horizontal plane the improved waterjet propulsor when a rotational centerline of said fluid accelerating rotor is horizontal.

4. The improved waterjet propulsor of claim 2 where the water inlet, on average, angles rearward from its upper to its lower portions at an angle of less than 50 degrees to a transverse horizontal plane of the improved waterjet propulsor when a rotational centerline of said fluid accelerating rotor is horizontal.

5. The improved waterjet propulsor of claim 2 where the water inlet, on average, angles rearward from its upper to its lower portions at an angle of less than 40 degrees to a transverse horizontal plane of the improved waterjet propulsor when a rotational centerline of said fluid accelerating rotor is horizontal.

6. The improved waterjet propulsor of claim 1 wherein an inlet lip of said water inlet is, at least in part, angled downward by an angle of less than twenty degrees to a transverse horizontal plane of the improved waterjet propulsor when a rotational centerline of said fluid accelerating rotor is horizontal.

7. The improved waterjet propulsor of claim 1 wherein an inlet lip of said water inlet is, at least in part, angled downward by an angle of less than fifteen degrees to a transverse horizontal plane of the improved waterjet propulsor when a rotational centerline of said fluid accelerating rotor is horizontal.

8. The improved waterjet propulsor of claim 1 wherein an inlet lip of said water inlet is, at least in part, angled downward by an angle of less than ten degrees to a transverse horizontal plane of the improved waterjet propulsor when a rotational centerline of said fluid accelerating rotor is horizontal.

9. The improved waterjet propulsor of claim 1 wherein said water inlet is, at least in its majority, disposed below a rotational centerline of the fluid accelerating rotor.

10. The improved waterjet propulsor of claim 1 wherein said water inlet is, at least in its majority, curvilinear in shape.

11. The improved waterjet propulsor of claim 1 wherein the adjustable inlet fluid directing means, when the marine is vehicle moving forward, can direct a majority of incoming water away from impacting the water inlet.

12. The improved waterjet propulsor of claim 1 wherein the adjustable inlet fluid directing means, when the marine vehicle is moving forward, can direct a majority of incoming water to the water inlet.

13. The improved waterjet propulsor of claim 1 wherein the adjustable inlet fluid directing means can direct incoming water to at least a majority of a fluid inlet portion of said fluid accelerating rotor.

14. The improved waterjet propulsor of claim 1 wherein the adjustable inlet fluid directing means is composed of two or more fluid directing elements wherein said fluid directing elements are moveable in relation to the improved waterjet propulsor.

15. The improved waterjet propulsor of claim 14 wherein movement of at least one of the fluid level directing elements is accomplished by forces supplied by an actuator.

16. The improved waterjet propulsor of claim 14 wherein one of said inlet fluid directing elements is a port inlet fluid directing element and another is a starboard inlet fluid directing element.

17. The improved waterjet propulsor of claim 16 wherein a center fluid directing element is actuated by contact with the port or the starboard fluid directing element.

18. The improved waterjet propulsor of claim 1 wherein a gas inlet of the gas supply means capable of supplying gas to the fluid accelerating rotor is, at least in its majority, above a waterline when the improved waterjet propulsor is generating forward thrust thereby supplying gas to an inlet portion of the fluid accelerating rotor and submerged below a waterline when the improved waterjet propulsor is generating reverse thrust thereby supplying water to the fluid accelerating rotor.

19. The improved waterjet propulsor of claim 18 wherein the fluid accelerating rotor rotates in the same direction when the improved waterjet propulsor is generating forward thrust as when it is generating reverse thrust.

20. The improved waterjet propulsor of claim 1 wherein a gas inlet that supplies gas to the fluid accelerating rotor during forward operation of the marine vehicle is, at least in its majority, submerged below a waterline during reverse operation of the marine vehicle.

21. The improved waterjet propulsor of claim 20 wherein the fluid accelerating rotor rotates in the same direction when the improved waterjet propulsor is generating reverse thrust as when it is generating forward thrust.

22. The improved waterjet propulsor of claim 1 which further comprises a steering rudder disposed, at least in its majority, all of said fluid accelerating rotor and forward of a multi-element fluid reversing bucket.

23. The improved waterjet propulsor of claim 22 wherein a housing portion forward of said steering rudder is, at least in its majority as seen in a vertical transverse plane of the improved waterjet propulsor, internally curvilinear in shape and a forward portion of said steering rudder as seen in a profile view, is curvilinear in shape such that rotation of the steering rudder causes a biased sideways directing of fluid flow during reverse thrust operation of the improved waterjet propulsor.

24. The improved waterjet propulsor of claim 22 wherein a housing portion forward of said steering rudder is, at least partially as seen in a vertical transverse plane of the improved waterjet propulsor, internally rectangular in shape over an upper portion and curvilinear in shape over a lower portion and a forward portion of said steering rudder, as seen in a profile view, is rectangular in shape over an upper portion and curvilinear in shape over a lower portion such that rotation of the steering rudder causes a biased sideways directing of fluid flow during reverse thrust operation of the improved waterjet propulsor.

25. The improved waterjet propulsor of claim 22 wherein said multi-element fluid reversing bucket comprises an element that is in mechanical communication with reverse fluid flow directing nozzles.

26. The improved waterjet propulsor of claim 22 wherein power for movement of a first element of said multi-element fluid reversing bucket is provided by an actuator and wherein movement of said first element of said multi-element fluid reversing bucket results in movement of an adjacent second element of said multi-element fluid reversing bucket.

27. The improved waterjet propulsor of claim 26 wherein movement the second element of said multi-element fluid reversing bucket results in movement of an adjacent third element of said multi-element fluid reversing bucket.

28. The improved waterjet propulsor of claim 22 wherein an aft portion of said steering rudder is, at least during portions of its operation during reversing of the improved waterjet propulsor, in close proximity to an element of the fluid reversing bucket.

29. In an improved propulsor in mechanical communication with and used for propelling a marine vehicle and having a fluid inlet and a fluid accelerating rotor where said fluid accelerating rotor is capable of operating efficiently when either partially or fully submerged in water, the improvement comprising:

said fluid accelerating rotor, over at least a majority of its lower half, surrounded by a housing with said housing including a water inlet disposed, at least in its majority, forward of a periphery of the fluid accelerating rotor and a gas supply means capable of supplying gas to the fluid accelerating rotor, a gas inlet of the gas supply means capable of supplying gas to the water accelerating rotor is, at least in its majority, above a waterline when the improved waterjet propulsor is generating forward thrust thereby supplying gas to a forward portion of the fluid accelerating rotor and submerged below a waterline when the improved waterjet propulsor is generating reverse thrust thereby supplying water to the fluid accelerating rotor, a fluid element reversing element disposed, when deployed to create reverse thrust, in its majority aft of the fluid accelerating rotor, and wherein said fluid accelerating rotor rotates in the same direction during both forward and reverse operation.

30. The improved marine propulsor of claim 29 which further comprises a fluid reversing element disposed, when deployed to create reverse thrust, in its majority aft of the fluid accelerating rotor.

31. The improved waterjet propulsor of claim 29 which further comprises an adjustable fluid level directing means.

32. The improved waterjet propulsor of claim 31 wherein the adjustable inlet fluid directing means can direct incoming water to at least a majority of an inlet of said fluid accelerating rotor.

33. The improved waterjet propulsor of claim 32 wherein said adjustable fluid directing means is composed of two or more fluid directing elements wherein said fluid directing elements are moveable in relation to the improved waterjet propulsor.

34. The improved waterjet propulsor of claim 33 wherein movement of at least one of the inlet fluid directing elements is accomplished by forces supplied by an actuator.

35. The improved waterjet propulsor of claim 33 wherein one of said fluid-directing elements is a port fluid directing element and another is a starboard fluid directing element.

36. The improved waterjet propulsor of claim 35 wherein a center fluid directing element is actuated by contact with the port or the starboard fluid directing element.

37. In an improved waterjet propulsor in mechanical communication with and used for propelling a marine vehicle and having a water inlet and a fluid accelerating rotor where said fluid accelerating rotor is capable of operating efficiently when either partially or fully submerged in water, the improvement comprising:

a gas inlet that supplies gas to the fluid-accelerating rotor during forward operation of the marine vehicle is, at least in its majority, submerged below a waterline during reverse operation of the marine vehicle and wherein said fluid accelerating rotor, over at least a majority of its lower half, is surrounded by a rotor housing.

38. The improved waterjet propulsor of claim 37 wherein said rotor housing is in mechanical communication with the water inlet with said water inlet disposed, at least in its majority, forward of a periphery of the fluid accelerating rotor.

39. The improved waterjet propulsor of claim 37 which further comprises an adjustable inlet fluid directing means disposed, at least in its majority, upstream of the fluid accelerating rotor.

40. The improved waterjet propulsor of claim 39 wherein the adjustable inlet fluid directing means can direct incoming water to at least a majority of an inlet of said fluid accelerating rotor.

41. The improved waterjet propulsor of claim 39 wherein said adjustable inlet fluid directing means is composed of two or more fluid directing elements and wherein said fluid directing elements are moveable in relation to the improved waterjet propulsor.

42. The improved waterjet propulsor of claim 41 wherein movement of at least one of the fluid level directing elements is accomplished by forces supplied by an actuator.

43. The improved waterjet propulsor of claim 41 wherein one of said fluid-directing elements is a port fluid directing element and another is a starboard fluid directing element.

44. The improved waterjet propulsor of claim 43 wherein a center fluid directing element is actuated by contact with the port or the starboard fluid directing element.

45. In an improved waterjet propulsor in mechanical communication with and used for propelling a marine vehicle and having a water inlet and a fluid accelerating rotor, the improvement comprising:

a steering rudder disposed, at least in its majority, aft of said fluid accelerating rotor and forward of a multi-element fluid reversing bucket and said multi-element reversing bucket having elements that, when deployed for reversing, form a, at least in its majority, curvilinear water directing shape that directs water forward to thereby generate reversing thrust, and wherein a housing portion forward of said steering rudder is, at least in part as seen in a vertical transverse plane of the improved waterjet propulsor, internally curvilinear in shape and a forward portion of said steering rudder, as seen in a profile view, is at least partially curvilinear in shape such that rotation of the steering rudder (A causes a biased sideways directing of fluid flow during reverse thrust operation of the improved waterjet propulsor and wherein said multi-element fluid reversing bucket further comprises an element that is in mechanical communication with reverse fluid flow directing nozzles.

46. The improved waterjet propulsor of claim 45 wherein a housing portion forward of said steering rudder is, at least partially as seen in a vertical transverse plane of the improved waterjet propulsor, internally rectangular in shape over an upper portion and curvilinear in shape over a lower portion and a forward portion of said steering rudder, as seen in a profile view, is rectangular in shape over an upper portion and curvilinear in shape over a lower portion such that rotation of the steering rudder causes a biased sideways directing of fluid flow during reverse thrust operation of the improved waterjet propulsor.

47. The improved waterjet propulsor of claim 45 wherein power for movement of a first element of said multi-element fluid reversing bucket is provided by an actuator and wherein movement of said first element of said multi-element fluid reversing bucket results in movement of an adjacent second element of said multi-element fluid reversing bucket.

48. The improved waterjet propulsor of claim 47 wherein movement the second element of said multi-element fluid reversing bucket results in movement of an adjacent third element of said multi-element fluid reversing bucket.

49. The improved waterjet propulsor of claim 45 wherein an aft portion of said steering rudder is, at least during portions of its operation during reversing of the improved waterjet propulsor, in lose proximity to an element of the fluid reversing bucket.

50. In an improved waterjet propulsor in mechanical communication with and used for propelling a marine vehicle and having a water inlet and a fluid accelerating rotor where said fluid accelerating rotor is capable of operating efficiently when either partially or fully submerged in water, the improvement comprising:

an adjustable inlet fluid directing means disposed, at least in its majority, forward of said fluid accelerating rotor and gas supply means capable of supplying gas to a forward portion of the fluid accelerating rotor and wherein said multi-element fluid reversing bucket further comprises an element that is in mechanical communication with reverse fluid flow directing nozzles.

51. The improved waterjet propulsor of claim 50 wherein the adjustable inlet fluid directing means can direct incoming water to at least a majority of an inlet of said fluid accelerating rotor.

52. The improved waterjet propulsor of claim 50 wherein said adjustable inlet fluid directing means is composed of two or more fluid directing elements and wherein said fluid directing elements are moveable in relation to the improved waterjet propulsor.

53. The improved waterjet propulsor of claim 52 wherein movement of at least one of the fluid level directing elements is accomplished by forces supplied by an actuator.

54. The improved waterjet propulsor of claim 52 wherein one of said fluid-directing elements is a port fluid directing element and another is a starboard fluid directing element.

55. The improved waterjet propulsor of claim 54 wherein a center fluid directing element is actuated by contact with the port or the starboard fluid directing element.

56. The improved waterjet propulsor of claim 50 wherein the inlet fluid directing means, when deployed downward, is capable of directing oncoming water away from the water inlet when the marine vehicle is moving forward.

* * * * *